US005431234A

United States Patent [19]

Klemm

[11] Patent Number: 5,431,234

[45] Date of Patent: Jul. 11, 1995

[54] GROUND-DRILLING DEVICE

[75] Inventor: Guenter W. Klemm, Olpe, Germany

[73] Assignee: Ing. G. Klemm, Germany

[21] Appl. No.: 133,148

[22] PCT Filed: Apr. 24, 1992

[86] PCT No.: PCT/EP92/00907

§ 371 Date: Oct. 15, 1993

§ 102(e) Date: Oct. 15, 1993

[87] PCT Pub. No.: WO92/19837

PCT Pub. Date: Nov. 12, 1992

[30] Foreign Application Priority Data

Apr. 25, 1991 [DE] Germany ..... 41 13 422.2

[51] Int. Cl.[6] ..... E21B 7/20

[52] U.S. Cl. ..... 173/184; 173/152

[58] Field of Search ..... 173/152, 141, 184

[56] References Cited

U.S. PATENT DOCUMENTS

| | | | |
|---|---|---|---|
| 3,126,063 | 3/1964 | Pitt et al. | 173/152 |
| 3,850,253 | 11/1974 | Lupton et al. | 173/152 |
| 3,915,241 | 10/1975 | Bieri | 173/152 |
| 4,553,612 | 11/1985 | Durham | 173/152 |

*Primary Examiner*—Scott A. Smith

*Attorney, Agent, or Firm*—Diller, Ramik & Wight

[57] ABSTRACT

The ground-drilling device comprises an elongated mount (10) comprising a track (11) for guiding a main carriage (25). The drive means for the main carriage (25) consists of a piston-cylinder unit (27) which extends below the track (11) under the main carriage and whose cylinder (28) is supported on the mount (10) via a link (29). The piston rod (30) engages the fore end of the main carriage (25). The piston-cylinder unit (27) does not project or only slightly projects beyond the rearward end of the mount (10).

16 Claims, 4 Drawing Sheets

GROUND-DRILLING DEVICE

BACKGROUND OF THE INVENTION

The invention relates to a ground-drilling device comprising a main carriage displaceable on a mount.

In-case of ground-drilling devices, the rotatingly driven drill column is advanced toward the drill hole with a pressure force being generated during drilling. The drilling unit rotating the drill rod is arranged on a carriage displaceable along the track of a mount. Mostly, the mount is arranged on a vehicle and it can be pivoted about a horizontal axis in order to drill drill holes with different angles of inclination. Normally, the advancing force for the carriage is raised by a hydraulic motor driving a chain hoist which advances the carriage with a desired pressure force so that the drill rod is firmly pressed against the base of the drill hole. A chain drive, however, has the disadvantage that it requires a long stable chain having at least about twice the length of the mount. Such chain drives are susceptible to soiling and chain rupture. In particular, when concrete is to be introduced into the drill hole, there is the risk that the chain links are loaded with concrete. In addition, bulky reducing gears are typically required. Another disadvantage of the known chain drives for the advancement of the main carriage consists in that a chain drive operates jerky in the pitch of the chain links so that a sensitive smooth jerkless advancement is not possible. To withdraw the drill column out of the drill hole, a rapid drive is typically required which also requires the use of a bulky transmission (DE 29 24 393 C2).

The use of piston-cylinder units for the direct advancement of the main carriage on the mount has so far failed due to the fact that such a piston-cylinder unit has to project rearwardly far beyond the mount since the displacement track normally extends essentially over the entire length of the mount. Owing to a far-projecting piston-cylinder unit, the length of the ground-drilling device is substantially increased beyond the length of the mount.

SUMMARY OF THE INVENTION

It is the object of the invention to provide a ground-drilling device which has a simplified drive device for advancing the main carriage and which does not require a transmission device, such as a chain drive, the length of the ground-drilling device, however, not being substantially increased.

In the case of the ground-drilling device according to the invention, the drive device for the main carriage consists of a linearly operating piston-cylinder unit extending below the track of the guide mount underneath the main carriage. Since the piston-cylinder unit overlaps with the main carriage, an essential part of the piston-cylinder unit is arranged in the area of the length of the mount so that only a relatively small part projects beyond the length of the mount, if such projection is present at all. Preferably, one single piston-cylinder unit is provided which is arranged in the space encompassed by the mount and which is laterally encompassed by the mount. However, it is possible to provide two such piston-cylinder units in parallel at the side of the mount.

The cylinder of the piston-cylinder unit may be arranged in a stationary manner on the mount, the piston being the movable member which engages the main carriage. This arrangement, however, may also be reversed such that the piston is supported on the mount and the cylinder engages the main carriage and is movable relative to the mount.

In the retracted state, the piston-cylinder unit is preferably located in the rearward half of the mount, the movable part of the piston-cylinder unit engaging the fore end of the main carriage. Alternatively, it is possible to arrange the piston-cylinder unit at the fore half of the length of the guide mount, the movable member of the piston-cylinder unit then engaging the rearward end of the main carriage. The forward end is the one facing the drill hole, which means the end being in front during the drill feed.

The invention permits a drill feed with high force and high efficiency because the force of the piston-cylinder unit is directly transmitted to the carriage, i.e. without transmission conversion or force deviation. The piston-cylinder unit permits a smooth and jerkless feed. Even under rough environmental conditions in dirty and concrete-containing surroundings, its functioning is secured. A special advantage is that the ground-drilling device has small cross sectional dimensions so that the mount can also be used under restricted circumstances where drives being laterally provided would disturb. The piston-cylinder unit permits a sensitive and slow feed as well as rapid forward and rearward movements without there being a need for a transmission or other space-requiring conversion units.

Hereinafter, embodiments of the invention will be described in detail in conjunction with the accompanying drawings in which:

DESCRIPTION OF THE PREFERRED EMBODIMENTS

Figure 1:
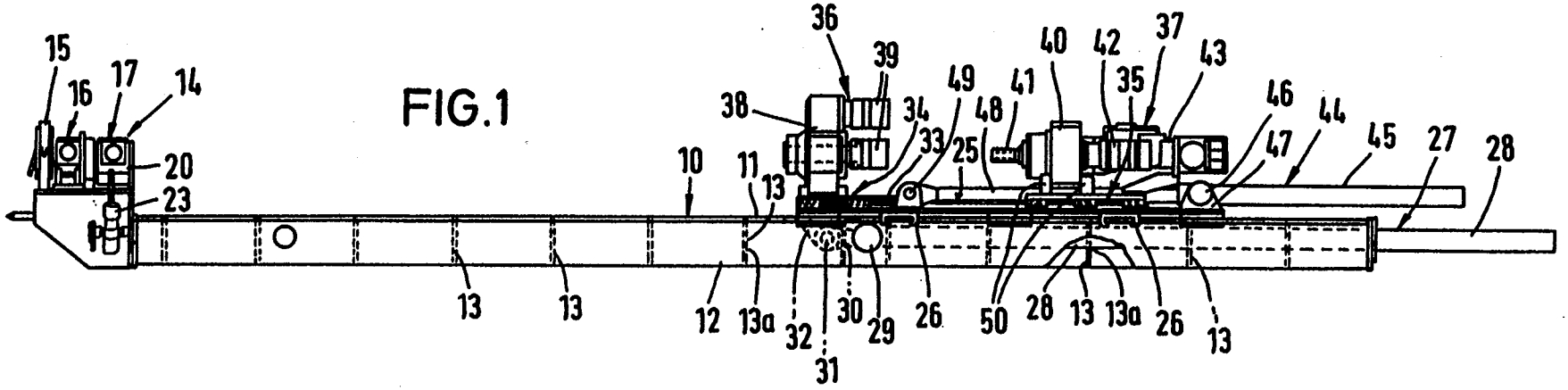
FIG. 1 is a side view of a first embodiment of the ground-drilling device.

In all embodiments, an elongated mount 10 is provided which may be arranged on a swivel arm of a vehicle and which is aligned with the drill hole to be drilled. On its upper side, the mount 10 comprises a linear track 11 which is formed by two parallel rails **11*a* and 11*b* which are mutually spaced. Each of the rails 11*a* and 11*b* is mounted to a side wall 12, and transverse supports 13 extend between these side walls and below the rails 11*a* and 11*b*. Each transverse support is formed of a flat sheet metal cut in the form of a U, the legs of which are welded to the side walls 12. The openings 13*a* of the U-shaped transverse supports 13 permit the passage of the piston rod of the piston-cylinder unit to be explained later on below the track 11** in the interior of the mount.

The mount head 14 carrying a guide ring 15 through which the drill rod or the drill pipe may be led in order to be introduced into the drill hole is arranged at the fore end of the mount 10. The guide ring 15 is divided so that the pipe can be transversely inserted into one ring half before the two ring halves are locked to each other.

Additionally, the mount head 14 carries a clamping device 16 and a clamping and rotating device 17. The clamping device 16 comprises two clamping jaws 18 which clamp the pipe and are driven by hydraulic cylinders 19 to clamp the pipe between them and secure it against rotation. The clamping and rotating device 17 includes a support 20 which is rotatable about the pipe axis and to which two clamping jaws 21 are attached which act upon the pipe from opposite sides and which are driven, respectively, by a cylinder 22. Another cylinder 23 (FIG. 1) drives the support 20 in such a manner that this support is rotated about the axis of the pipe. The clamping device 16 and the clamping and rotating device 17 serve for releasing the screw connection of two drill rods or the screw connection of pipes, which has been tightened during the high-force drilling procedure. Therefore, the one pipe is held by the clamping device 16, while the other pipe is held by the clamping and rotating device 17 and subsequently rotated by the cylinder 23.

Each of the illustrated embodiments further comprises a main carriage 25 which is guided along the track 11 of the mount 10 and therefore comprises guide jaws 26 which laterally encompass the rails 11*a* and 11*b* from outside and hold the main carriage 25 on the track 11 in such a manner that the main carriage is exclusively movable in the longitudinal direction of the track.

In all embodiments, the main carriage 25 is driven by a hydraulic piston-cylinder unit 27 whose cylinder 28 is supported, with its forward end, in the central area of the length of the mount 10. The forward end of the cylinder 28 is supported, via a link, between the side walls 12 of the mount 10. Therefore, the cylinder comprises axle stubs projecting to opposed sides and forming the axis of the link 29. The link 29 is the only support or fixture of the cylinder 28 at the mount. Due to the pivotability of the cylinder 28 about the link 29, the cylinder is able to adjust freely corresponding to the direction of effect of the forces. Besides, the cylinder is loosely supported on the transverse supports 13 through the openings 13*a* of which it projects.

The open end of the cylinder 28 is located at the link 29. Out of this open end, the piston rod 30 can be extended, which is shown in the retracted or withdrawn state, respectively, in the drawings. Via a link 31, the piston rod 30 engages a hanging bearing 32 which depends from the main carriage 25 in the region between the rails 11*a* and 11*b* and is rigidly connected to the fore end of the main carriage 25.

When the cylinder 28 is pressurized, the piston rod 30 is extended to the front. Since the piston rod engages the fore end of the main carriage 25, it acts in a drawing manner on the main carriage when the drill rod or the drill pipe, respectively, is advanced. Thus, the main carriage is not rearwardly displaced which would imply the danger of upsetting and arching.

The length of the cylinder 28 and the piston rod 30, respectively, is so great that the forward end of the main carriage 25 can be advanced up to the forward end of the mount 10. When the link 29 is precisely at the center of the mount's length, the cylinder 28 is so short that it does not project or not project substantially out of the rearward end of the mount. In case of the embodiments shown, the link 29, however, is offset farther in the rearward direction so that the cylinder 28 rearwardly projects beyond the mount. This projection, however, preferably does not amount to more than a third of the length of the cylinder 28 and preferably not to more than a quarter of the cylinder length.

Figure 2:
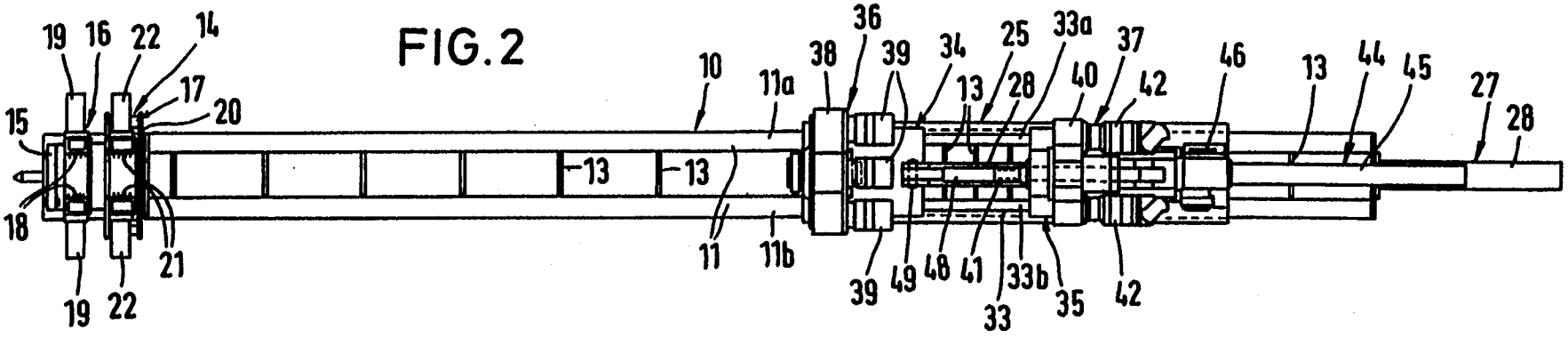
FIG. 2 is a top plan view of FIG. 1.

In the embodiment of FIGS. 1 and 2, two subcarriages, namely the a forward subcarriage 34 and a rear subcarriage 35, are arranged on a track 33 of the main carriage 25, which track consists of two parallel rails 33*a* and 33*b*. In this embodiment, the rear or rearward subcarriage 35 is clamped to the track 33, i.e. it is fixed to the main carriage 25, whereas the forward subcarriage 34 is displaceable in the longitudinal direction of the track 33.

The forward subcarriage 34 carries a drilling unit 36 for rotating a drill pipe which is used as outer pipe. The rearward subcarriage 35 carries a drilling unit 37 for rotating and striking on an inner pipe which extends within the outer pipe. The drilling unit 36 comprises a drive housing 38 in which a rotary ring (not shown) is provided which is connected to the outer pipe for common rotation therewith. The rotary ring is driven by several motors 39 which axially project from the drive housing 38 and drive the rotary ring by means of their output shafts.

The drive unit 37 on the rearward carriage 35 comprises a drive housing 40 containing a rotary ring for rotating the output end 41 which is connected to the inner pipe for common rotation therewith and for being resistant to impacts. At the drive housing 40, several motors 42 are provided which commonly drive the rotary ring. Moreover, the drilling unit 37 comprises an impact hammer 43 which exerts impacts on an impact member connected to the output end 41 and thus strikes on the rearward end of the inner pipe.

While the rearward subcarriage 35 is fixed to the main carriage 25, the forward subcarriage 34 can be moved in the longitudinal direction, namely by means of the second piston-cylinder unit 44 whose cylinder 45, with its forward end, is pivotably supported via a link 46 on a block 47 projecting upwardly from the rearward end of the main carriage. From the link 46, the cylinder 45 projects freely backward without any other support. The piston rod 48 which is connected to the rear end of the forward subcarriage 34 via a link 49 projects out of the forward end of the cylinder 45. The longitudinal axis of the piston rod 48 extends only slightly above the rails 33*a* and 33*b* forming the track 33 of the main carriage, and it passes underneath the drilling unit 37 which stands with feet 50 on the subcarriage 35.

The drilling apparatus according to FIGS. 1 and 2 permits to perform overburden drilling, wherein an inner rod and an outer rod are advanced simultaneously, the outer rod only being rotated, the inner rod, however, being rotated and struck. The drill feed is effected by the main carriage 25 advanced by the piston-cylinder unit 27. By actuation of the second piston-cylinder unit 44, the forward subcarriage 34 can optionally be advanced or withdrawn to displace the outer pipe rod with respect to the inner pipe rod.

Figure 3:
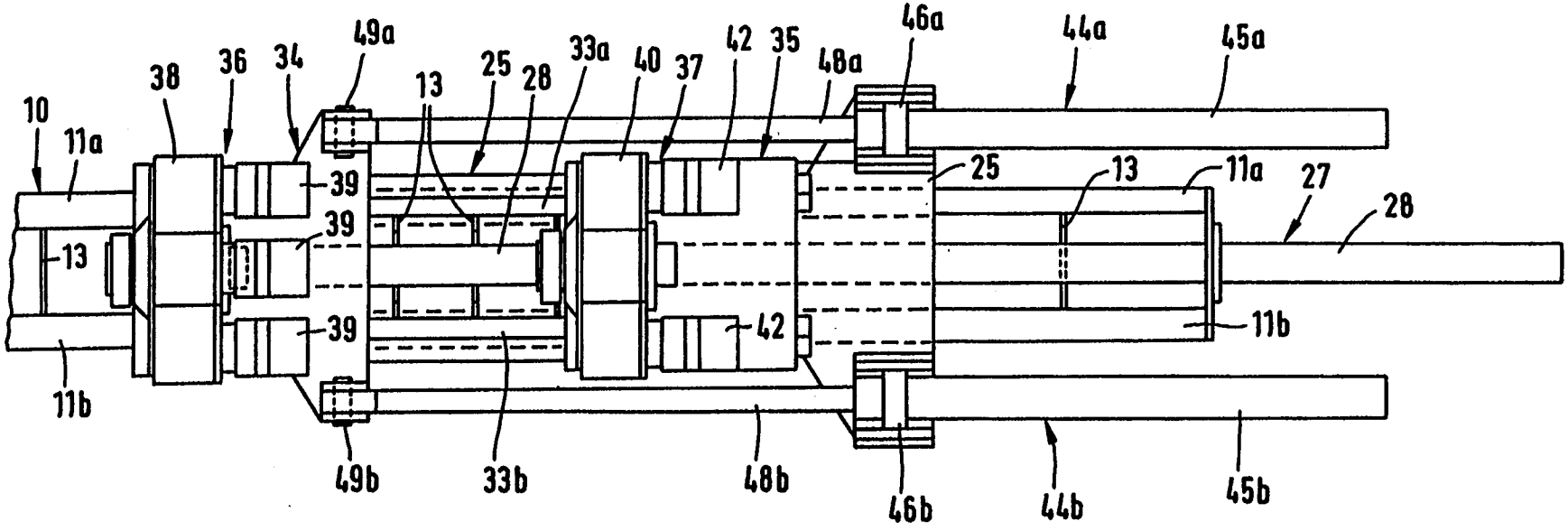
FIG. 3 is a top plan view of the rearward mount portion with the main carriage in a second embodiment, wherein a subcarriage is driven by two piston-cylinder units.

The embodiment shown in FIG. 3 differs from the first embodiment only in that instead of the second piston-cylinder unit 44, two second piston-cylinder units 44*a* and 44*b* are provided whose cylinders 45*a* and 45*b* are pivotably supported by means of links 46*a*,46*b* on the rearward end of the main carriage 25 and project rearwardly. In this case, the piston-cylinder units 44*a* and 44*b* are arranged on both sides of the main carriage 25 so that their piston rods 48*a* and 48*b* laterally extend beside the drilling unit 37 and respectively engage a link 49*a* or 49*b*, respectively, on both sides of the rearward end of the fore subcarriage 34. The cylinders 45*a* and 45*b* are synchronously pressurized so that the piston rods 48*a* and 48*b* are driven synchronously, respectively. In this case also, the piston rods of the second piston-cylinder units have a length being substantially greater than that of the respective cylinders so that the length of the second subcarriage 35 can be bridged.

Figure 4:
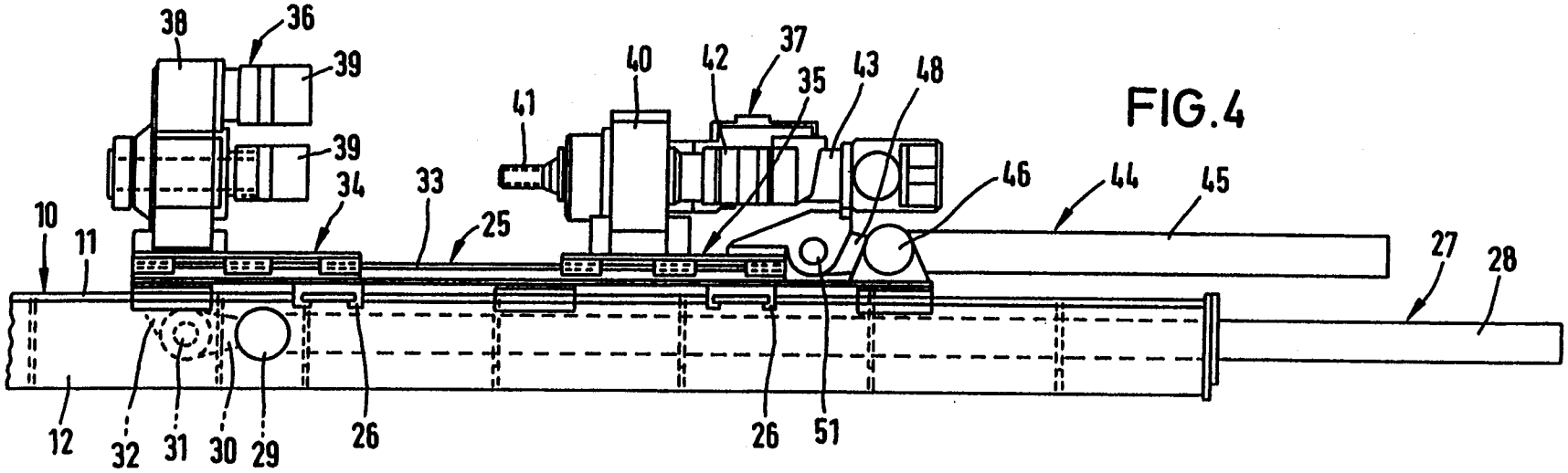
FIG. 4 is a partial side view of an embodiment with two subcarriages, the rearward subcarriage of which is displaceable on the main carriage.

The embodiment of FIG. 4 differs from the first embodiment only in that the forward subcarriage 34 is fixed to the main carriage, whereas the rearward subcarriage 35 is displaced along the track 33 by means of the second piston-cylinder unit 44. The piston rod 48 of the second piston-cylinder unit here engages the rearward end of the rearward subcarriage 35 via a link 51.

It is also possible to perform overburden drillings with the drilling apparatus of FIG. 4, with the outer pipe rod carrying a ring bore crown and the inner rod carrying a full bore crown. The outer rod is advanced by the main carriage 25, while the inner rod is displaceable relative to the outer rod by moving the subcarriage 35.

Figure 5:
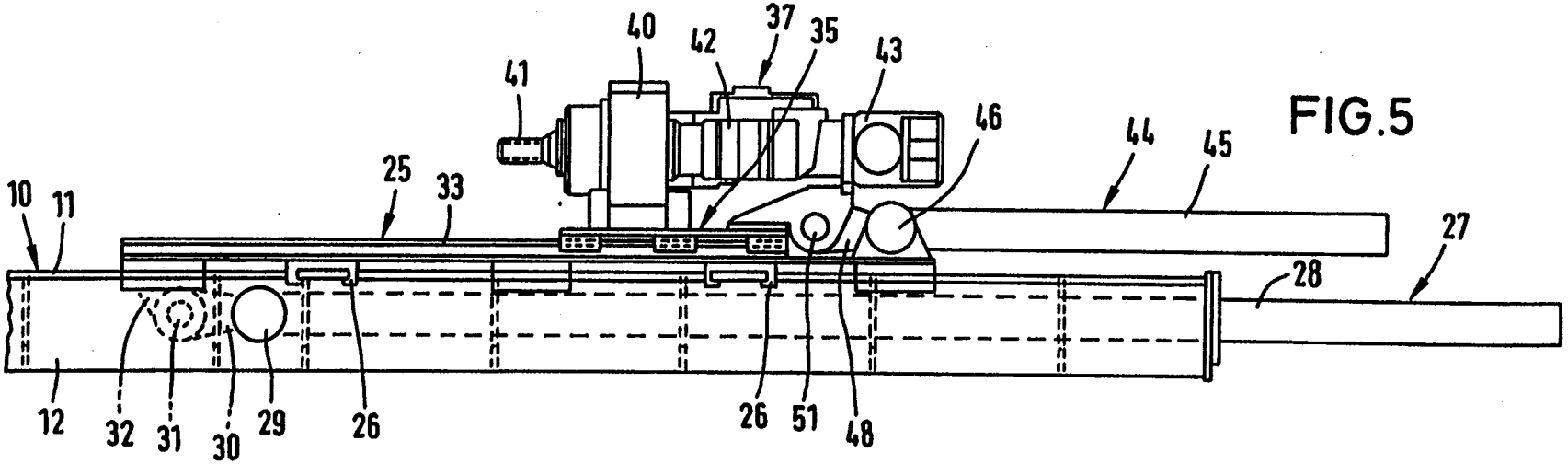
FIG. 5 shows an embodiment comprising only one single subcarriage.

The ground-drilling device according to FIG. 5 comprises only a single subcarriage 35 which is displaceable along the entire length of the track 33 of the main carriage 25 by means of the second piston-cylinder unit 44. Via a link 51, the piston rod 48 of this piston-cylinder unit engages the hanging bearing provided on the rearward end of the only subcarriage 35. The longitudinal axis of this piston rod 48 extends only slightly above the plane of the rails 33*a* and 33*b* of the track 33.

The ground-drilling device according to FIG. 5 can be used in such a manner that at first, the main carriage 25 is advanced on the guide mount 10, and thereafter, the subcarriage 35 is advanced on the main carriage 25, or vice versa. Thereby, a tandem-like advancement is possible, the main carriage 25 along with the mount 10 forming a telescope-like structure. Thus, the entire advancement length is prolonged with respect to the length of the advancement of the main carriage 25 on the mount 10.

Here as well, the subcarriage 35 is provided with the described drilling unit 37 consisting of rotary drive and impact hammer.

Figure 6:
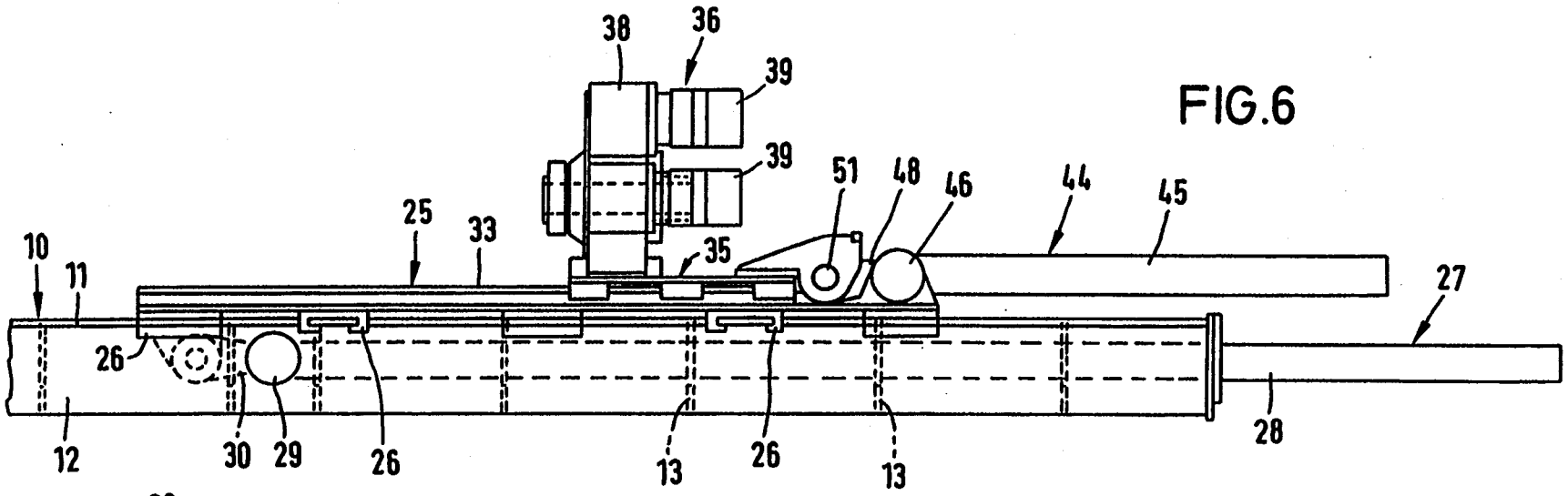
FIG. 6 shows an embodiment comprising a single subcarriage and a drilling unit which is exclusively destined for rotating the drill rod.

The embodiment of FIG. 6 differs from that of FIG. 5 in that a drilling unit 36, which includes only a rotary drive but no impact drive, is arranged on the only subcarriage 35 which is displaceable along the track 33 of the main carriage 25.

Figure 7:
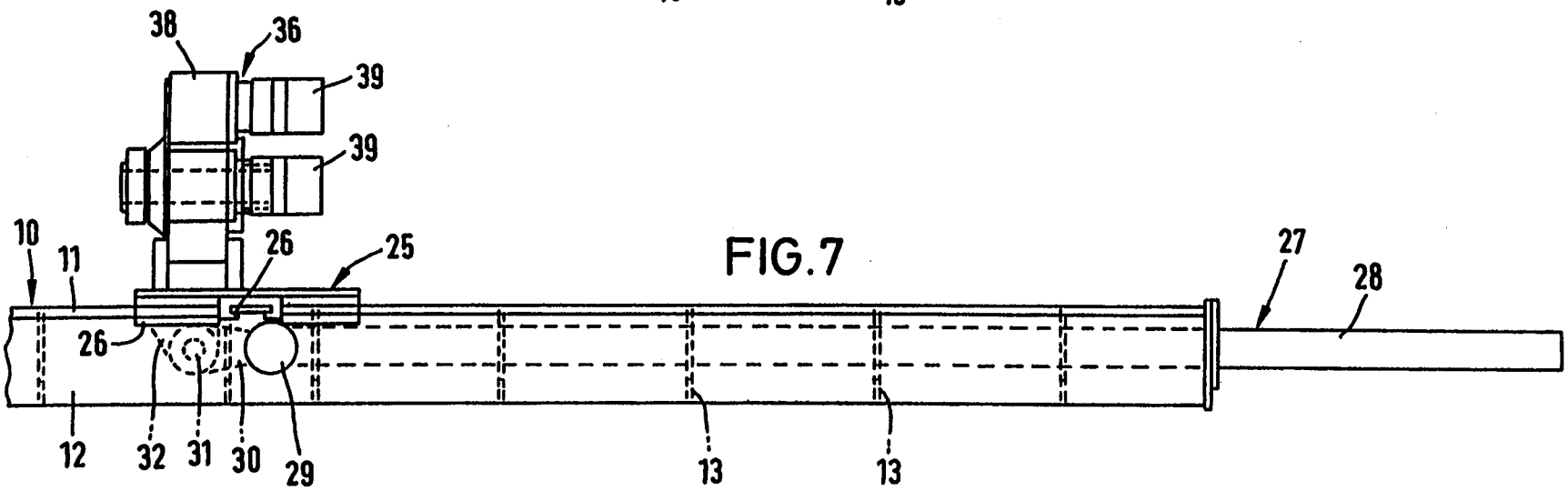
FIG. 7 shows an embodiment comprising only one main carriage which is fixed onto the drilling unit.

The embodiment of FIG. 7 differs from that of FIG. 6 only in that the main carriage 25 is essentially shorter and has about the length of the previously described subcarriage 34. The main carriage 25 which is displaceable along the track 11 of the mount 10 by means of the piston-cylinder unit 27 here carries a drilling unit 36 with rotary drive, but without impact hammer.

The various illustrated and described variants show that the ground-drilling device can be constructed in modular technique, the tracks 11 of the mount and 33 of the main carriage advantageously having the same rail dimensions so that a subcarriage can optionally be operated both on the track of the mount and the track of a main carriage. It is then possible to use the same carriage as subcarriage or as main carriage. Further, the carriages are configured such that the drilling units thereon are exchangeable, i.e. that each carriage can be equipped with different drilling units which are exchangeably mounted thereon.

Although a preferred embodiment of the invention has been specifically illustrated and described herein, it is to be understood that minor variations may be made in the apparatus without departing from the spirit and scope of the invention, as defined the appended claims.

I claim:

1. A ground-drilling device comprising a longitudinal mount (10) on which a main carriage (25) is displaceable along a track (11), drive means for moving said main carriage (25) along said mount (10) in reciprocally opposite first forward and second rearward directions, at least one drilling unit (36; 37) arranged on said main carriage (25) for rotating a drill rod, said main carriage (25) having forward and rearward end portions, said drive means including a piston-cylinder unit (27) arranged under said track (11) beneath said main carriage (25), said piston-cylinder unit (27) including a cylinder (28) and a piston rod (30), said cylinder (28) and piston rod (30) each having forward and rearward end portions, means (31) for connecting said piston rod forward end portion to said main carriage forward end portion, means (29) for connecting said cylinder forward end portion to said mount (10), and said piston rod and cylinder rearward end portions project rearwardly of said piston rod forward end portion connecting means.

2. The ground-engaging device according to claim 1 wherein said cylinder forward end connecting means include a pivot having an axis transverse to the movements of said main carriage.

3. The ground-engaging device according to claim 2 wherein said pivotal connecting means includes a pivot axis disposed generally transverse to the direction of displacement of said at least one drilling unit.

4. The ground-engaging device according to claim 1 wherein said track includes forward and rearward end portions, said cylinder has a predetermined length, and the distance between said track forward end portion and said cylinder forward end portion connection means corresponds substantially to the length of said cylinder.

5. The ground-engaging device according to claim 1 including at least one subcarriage (34; 35) carried by said carriage (25), said at least one subcarriage (34; 35) having a second track (33), said at least one drilling unit (35; 37) being displaceable along said second track (33), and a second piston-cylinder unit (44) between said at least one drilling unit (36; 37) and said main carriage (34; 35) for displacing said at least one drilling unit.

6. The ground-engaging device according to claim 5 wherein a single subcarriage (35) is provided and displaceable along said second track (33).

7. The ground-engaging device according to claim 5 wherein two subcarriages (34, 35) and two drilling units (36; 37) are provided with one drilling unit (36) being carried by one subcarriage (34) and another drilling unit (37) being carried by the other subcarriage (35).

8. The ground-engaging device according to claim 7 wherein said second piston-cylinder unit (44) includes a cylinder (45) and a piston rod (48) which passes beneath said other subcarriage (35).

9. The ground-engaging device according to claim 7 wherein said second piston-cylinder unit (44) includes a cylinder (45) and a piston rod (48) which passes laterally of said other subcarriage (35).

10. The ground-engaging device according to claim 5 wherein two subcarriages (34, 35) and two drilling units (36; 37) are provided with one drilling unit (36) being carried by one subcarriage (34) and another drilling unit (37) being carried by the other subcarriage (35), and said second piston-cylinder unit (44) displaces said other subcarriage (35).

11. The ground-engaging device according to claim 5 wherein two subcarriages (34, 35) and two drilling units (36; 37) are provided with one drilling unit (36) being carried by one subcarriage (34) and another drilling unit (37) being carried by the other subcarriage (35), and said second piston-cylinder unit (44) displaces said one subcarriage (34).

12. The ground-engaging device according to claim 1 including at least one subcarriage (34; 35) carried by said carriage (25), said at least one subcarriage (34; 35) having a second track (33), said at least one drilling unit (35; 37) being displaceable along said second track (33), a second piston-cylinder unit (44) between said at least one drilling unit (36; 37) and said main carriage (34; 35) for displacing said at least one drilling unit, said second piston-cylinder unit (44) including a second cylinder (45) and a second piston rod (48), said second cylinder (45) and second piston rod (48) each having forward and rearward end portions, and means (46) for connecting said second cylinder (45) to said main carriage (25).

13. The ground-engaging device according to claim 1 including at least one subcarriage (34; 35) carried by said carriage (25), said at least one subcarriage (34; 35) having a second track (33), said at least one drilling unit (35; 37) being displaceable along said second track (33), a second piston-cylinder unit (44) between said at least one drilling unit (36; 37) and said main carriage (34; 35) for displacing said at least one drilling unit, said second piston-cylinder unit (44) including a second cylinder (45) and a second piston rod (48), said second cylinder (45) and second piston rod (48) each having forward and rearward end portions, and pivotally connecting means (46) for connecting said second cylinder (45) to said main carriage (25).

14. The ground-engaging device according to claim 1 including at least one subcarriage (34; 35) carried by said carriage (25), said at least one subcarriage (34; 35) having a second track (33), said at least one drilling unit (35; 37) being displaceable along said second track (33), a second piston-cylinder unit (44) between said at least one drilling unit (36; 37) and said main carriage (34; 35) for displacing said at least one drilling unit, said second piston-cylinder unit (44) including a second cylinder (45) and a second piston rod (48), said second cylinder (45) and second piston rod (48) each having forward and rearward end portions, and means (46) for connecting said second cylinder (45) to said main carriage (25) at said main carriage rearward end portion.

15. The ground-engaging device according to claim 1 including at least one subcarriage (34; 35) carried by said carriage (25), said at least one subcarriage (34; 35) having a second track (33), said at least one drilling unit (35; 37) being displaceable along said second track (33), a second piston-cylinder unit (44) between said at least one drilling unit (36; 37) and said main carriage (34; 35) for displacing said at least one drilling unit, said second piston-cylinder unit (44) including a second cylinder (45) and a second piston rod (48), said second cylinder (45) and second piston rod (48) each having forward and rearward end portions, and pivotal connecting means (46) for connecting said second cylinder (45) to said main carriage (25) at said main carriage rearward end portion.

16. The ground-drilling device according to claim 1, characterized in that said cylinder (28) is supported by transverse supports (13) on said mount (10) which extend between side walls (12) of said mount.

* * * * *